US007892010B2

(12) United States Patent
Lux

(10) Patent No.: US 7,892,010 B2
(45) Date of Patent: Feb. 22, 2011

(54) ELECTRIC DEVICE WITH PROTECTIVE CLOSURE DEVICE FOR CONTACT TUBES OF THE PLUG RECEPTACLE

(75) Inventor: Karl-Heinz Lux, Weikersheim (DE)

(73) Assignee: BARTEC GmbH, Bad Mergentheim (DE)

( * ) Notice: Subject to any disclaimer, the term of this patent is extended or adjusted under 35 U.S.C. 154(b) by 0 days.

(21) Appl. No.: 12/687,942

(22) Filed: Jan. 15, 2010

(65) Prior Publication Data

US 2010/0178787 A1 Jul. 15, 2010

(30) Foreign Application Priority Data

Jan. 15, 2009 (DE) ..... 10 2009 005 052

(51) Int. Cl.
*H01R 13/625* (2006.01)
*H01R 4/50* (2006.01)

(52) U.S. Cl. ..... 439/342; 439/157; 439/271; 439/259; 439/689

(58) Field of Classification Search ..... 439/157, 439/271, 519, 342, 259, 268, 266, 686, 752, 439/689

See application file for complete search history.

(56) References Cited

U.S. PATENT DOCUMENTS 7,179,132 B2 * 2/2007 Flowers ..... 439/686

* cited by examiner

*Primary Examiner*—Javaid Nasri
(74) *Attorney, Agent, or Firm*—Gudrun E. Huckett

(57) ABSTRACT

An electric device has a plug connection provided with a plug that has at least one contact pin and further provided with a mating plug receptacle that has at least one contact tube. A closure device is arranged on the plug receptacle and has a closed position for protecting the at least one contact tube. The closure device is moved by the plug into an open position when the plug is inserted into the plug receptacle, wherein in the open position the at least one contact tube is released.

15 Claims, 7 Drawing Sheets

ELECTRIC DEVICE WITH PROTECTIVE CLOSURE DEVICE FOR CONTACT TUBES OF THE PLUG RECEPTACLE

BACKGROUND OF THE INVENTION

The invention relates to an electric device with a plug connection comprising a plug with at least one contact pin and a plug receptacle with at least one contact tube.

It is an object of the present invention to further develop an electric device of the aforementioned kind so that, with simple means, the contact tube is protected from foreign media and contamination and unhindered access of the contact tube for safe contacting of the contact pin in the contact tube is ensured.

SUMMARY OF THE INVENTION

In accordance with the present invention, this is achieved in that the plug connection, comprising a plug and a mating plug receptacle, comprises furthermore a closure device protecting the contact tube. The closure device is correlated with the plug receptacle and is movable by means of the plug into an open position that releases (provides access to) the contact tube when the plug is inserted into the plug receptacle.

The contact pin of the plug is correlated with electric or electronic components.

The contact tube of the plug receptacle is correlated with electric supply lines and/or electric outgoing lines.

The contact tube is arranged in an electrically non-conducting insulation body.

The insulation body with the contact tube is floatingly arranged in the plug receptacle.

The insulation body has an insertion part that projects past the tube opening of the contact tube and the insertion part has an insertion bore for the contact pin.

The insertion bore in the insertion part of the insulation body has a diameter that is slightly greater than that of the contact pin.

Between the circumferential surface of the contact pin and the inner surface of the insertion bore a spark ignition-proof explosion protection gap is formed that fulfills the explosion protection regulations.

The closure device is arranged in a plane above the insertion bore of insulation body.

The closure device is arranged on the topside of the plug receptacle facing the plug.

The closure device comprises a sealing plate.

The sealing plate of the closure device has at least one through bore that is coaxial to the tube opening of the contact tube and/or the insertion bore of the insulation body.

The sealing plate of the closure device is comprised of rubber-elastic material.

The sealing plate rests on the topside of the plug receptacle facing the plug.

The closure device comprises a cover plate.

The cover plate of the closure device has at least one through bore for the contact pin of the plug.

The cover plate of the closure device is provided on the side of the sealing plate facing away from the contact tube.

The cover plate of the closure device is slidable within the plane of its flat extension.

When the plug is inserted in the plug receptacle, the cover plate is in an open position in which the through bore is coaxial to the contact tube, wherein, when the plug connection is decoupled, the cover plate is moved into a closed position in which the through bore is positioned in a radially displaced position adjacent to the through bore of the sealing plate.

The through bore of the sealing plate in the closed position of the cover plate is closed off by the latter and is surrounded by a seal.

This seal is arranged on the side of the cover plate that is facing the sealing plate.

This seal is formed monolithically on the cover plate and is embodied as an annular projection that is pressing against the sealing plate.

The cover plate, for its displacement, has correlated therewith at least one spring.

The cover plate is secured by means of the spring in its closed position.

The cover plate is movable against the force of the spring into the open position.

The spring is supported on a follower part of the cover plate.

The cover plate has at least one driven part for the displacement action.

The driven part of the cover plate comprises a gliding surface for interacting with at least one drive part.

The drive part that interacts with the driven part of the cover plate is arranged on the plug.

The drive part has a pushing surface that is oriented toward the driven part of the cover plate.

The pushing surface is a ramp surface and the glide surface is a rounded surface or the pushing surface is a rounded surface and the glide surface is a ramp surface.

The drive part is longer in the insertion direction of the plug than the contact pin and the pushing surface projects past the free end of the contact pin.

The closure device has a fastening frame that is arranged on the plug receptacle.

The sealing plate, the cover plate, and the spring are secured by means of the fastening frame on the plug receptacle.

The plug connection has a sealing device that preferably comprises a shaped seal that surrounds the closure device of the plug receptacle and a sealing stay that surrounds the contact pin of the plug and matches the shaped seal.

The plug with the contact pin is arranged on the bottom side of the assembly housing which bottom side is facing a frame housing.

The plug receptacle with the contact tube and the closure device are arranged on a frame housing that receives an assembly housing.

The frame housing has at least one support wall that rests against a sidewall of the assembly housing.

On the sidewall of the assembly housing at least one stay is arranged that is guided in a longitudinal groove that extends in the insertion direction of the assembly housing and is formed on the support wall of the frame housing.

The assembly housing is lockable on the frame housing by an actuator that is pivotably secured on the support wall of the frame housing.

The pivotable connection of the actuator comprises at least one bearing part that is arranged in a bearing receptacle wherein preferably the bearing part is arranged on the actuator and the bearing receptacle is formed in the support wall of the frame housing.

The actuator is securable on the frame housing in a non-detachable way by a blocking device that is comprised of a blocking member preferably arranged on the support wall and engaging a blocking member receptacle on the actuator.

The locking action of the actuator comprises at least one looking pin that is preferably arranged on the sidewall of the assembly housing and is supported in a guide groove that is of a semi-circular shape and provided on the bearing part of the actuator, wherein the guide groove extends from an insertion opening that is provided on the circumferential rim of the bearing part approximately in a radial direction in a direction toward the pivot axis of the actuator.

The bearing receptacle in the support wall of the frame housing has an inlet opening for the looking pin.

After insertion of the looking pin into the insertion opening and a slight pivoting action of the actuator in the direction of the locked position, the looking pin is positively secured against sliding out of the guide groove.

After insertion of the looking pin into the insertion opening and a slight pivoting action of the actuator in the direction of the locked position, between the contact pin and the contact tube in the insulation body a minimum contact spacing in accordance with explosion protection regulations is provided.

After insertion of the assembly housing into the frame housing and pivoting of the actuator into the locked position, the contact pin engages the contact tube.

After insertion of the assembly housing into the frame housing and pivoting of the actuator into the locked position, the sealing stay of the plug rests against the shaped seal of the plug receptacle.

The actuator in the locked position is secured against accidental return pivoting into the release position.

The frame housing with the plug receptacle and the closure device are releasably secured by means of a slidably supported locking device on a cap rail that is U-shaped in cross-section.

The locking device in the locked position of the actuator is secured by the latter against accidental displacement.

The assembly housing comprising the plug has on each of opposed sidewalls a locking pin and a stay, wherein the frame housing has two spaced-apart, parallel support walls between which the plug receptacle with the closure device is provided, wherein the support walls each have a bearing receptacle with an inlet opening as well as a locking cam, a longitudinal groove, and a blocking member, wherein the support walls are connected by an end wall, and wherein the actuator has two legs and a grip part connecting the two legs so that a U-shaped bracket is formed, and wherein on each of the two legs a bearing part with the guide groove and the insertion opening as well as blocking member receptacle are provided.

DESCRIPTION OF THE PREFERRED EMBODIMENTS

Figure 1:
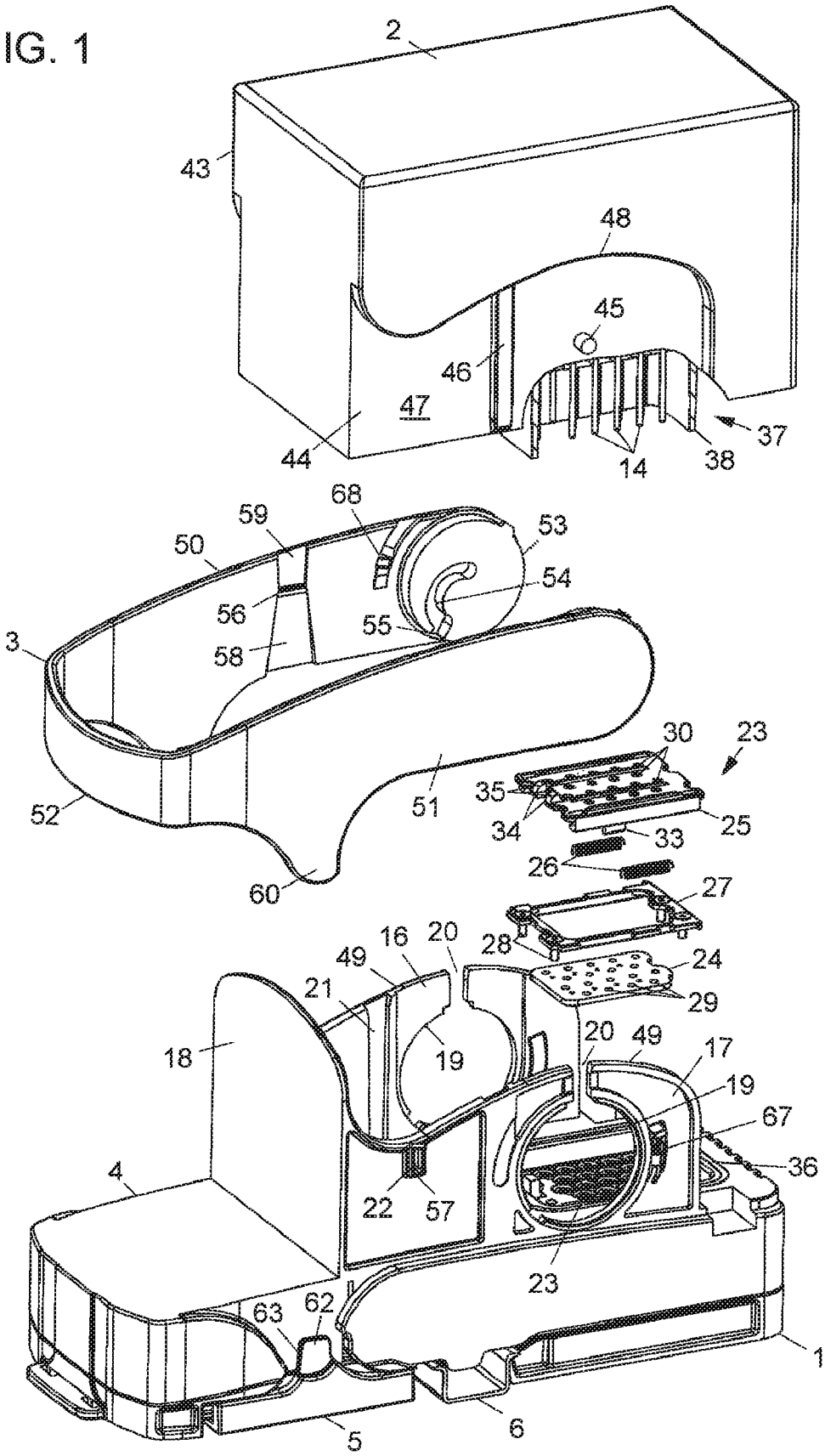
FIG. 1 shows the electric device according to the invention in an exploded view.

The electric device according to the invention is provided for use in areas that are endangered by dust, dirt, moisture, splash water, and ignitable atmospheres. The device comprises a frame housing 1, an assembly housing 2 insertable into the latter, and an actuator 3 for providing a releasable locking action for the assembly housing 2 in the frame housing 1.

The frame housing 1 has a base member 4 and is releasably attached by a locking device 5 to a support rail in the form of a cap rail (top hat rail) 6 that is approximately U-shaped in cross-section. For this purpose, the locking device 5 is supported on the base member 4 so as to be movable transversely to the longitudinal direction of the cap rail 6. On the side of the cap rail 6 opposite the locking device 5 the base member 4 has a plug receptacle 7 with several contact tubes 8 that are spaced apart from one another. The contact tubes 8 may be surrounded by a boundary wall 9 that is expediently formed of four walls with neighboring ones positioned at a right angle to one another so that the plug receptacle 7 in cross-section is substantially rectangular.

Each individual contact tube 8 is arranged in an electrically non-conducting insulation body 10 that may be embodied as a cylinder of approximately circular cross-section. The insulation body 10 can be significantly longer than the contact tube 8 that is arranged expediently in the lower part of the insulation body 10 so that an insertion part 11 of the insulation body 10 projects by a significant length past the tube opening 12 of the contact tubes 8. The insertion part 11 of the insulation body 10 has an insertion bore 13 that is arranged coaxially to the contact tube 8 and into which a contact pin 14 is insertable. In order to facilitate introduction of the contact pins 14 into the insertion bores 13, the insulation bodies 10 with the contact tubes 8 may be floatingly supported in the plug receptacle 7. On the contact tubes 8 moreover sleeve-shaped connecting parts 15 can be formed which project from the plug receptacle 7 and to which electrical lines may be connected, for example, by soldering or crimping.

On the topside of the base member 4 two support walls 16, 17 that are parallel to and spaced apart from one another are arranged and connected to one another by means of a transversely arranged end wall 18 so that a receiving space is provided that is delimited on three sides. On each of the two support walls 16, 17 there is a circular bearing receptacle 19; the bearing receptacles 19 are positioned opposite one another. Each bearing receptacle 19 has correlated therewith an inlet opening 20 that is formed in the support walls 16, 17 as a slot-shaped cutout. Moreover, the support walls 16, 17 are provided at their inner sides with oppositely positioned longitudinal grooves 21 that extend in the insertion direction of the assembly housing 2. The exterior sides of the support walls 16, 17 have locking cams 22 oppositely positioned relative to one another. Moreover, the support walls 16, 17 each have a blocking member 67 that is arranged adjacent to the circumferential area of the bearing receptacle 19.

On the frame housing 1 a closure device 23 is provided that is arranged on the topside of the plug receptacle 7, i.e., in a plane above the plug receptacle, preferably directly above the insertion bores 13 of the insulation body 10. The closure device 23 comprises a sealing plate 24, a cover plate 25, two springs 26 as well as a fastening frame 27 that is preferably attached by means of screws 28 to the plug receptacle 7 or the base member 4 of the frame housing 1 and by means of which the aforementioned closure device parts 24, 25, 26 are secured.

The approximately flat rectangular sealing plate 24 may be comprised of a rubber-elastic material and is preferably comprised of silicone, EPDM, or VITON® (fluoroelastomer). It is positioned flat and flush directly on the topside of the plug receptacle 7 and has through bores 29 that are spaced apart from one another and are aligned coaxially to the insertion bores 13 of the insulation bodies 10 as well as the contact tubes 8.

The cover plate 25 is positioned flush and flat on a top side of the sealing plate 24 that is facing away from the insulation bodies 10. It has through bores 30 that are positioned at the same spacings relative to one another as the through bores 29 of the sealing plate 24, the insertion bores 13, and the contact tubes 8. The cover plate 25 is movably supported relative to the stationary sealing plate 24 within the fastening frame 27 within its plane. On the bottom side of the cover plate that is resting on the sealing plate 24 seals 31 are provided that are preferably embodied as circular-annular projections and are monolithically formed together with the cover plate 25. The projecting seals 31 (FIG. 6) project thus to some degree away from the bottom side of the cover plate 25 and are pressed against the top surface of the sealing plate 24 so that the through bores 29 of the sealing plate 24 in the closed position of the cover plate 25 are closed by the latter and surrounded by the seals 31.

Figure 4:
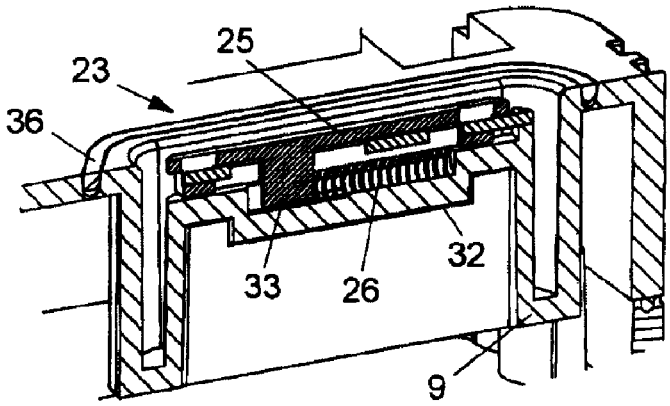
FIG. 4 shows a detail view of the closure device of the frame housing according to detail IV of FIG. 3.

The springs 26 can be expediently embodied as coil-shaped pressure springs and supported in a cutout 32 of the plug receptacle 7 (FIG. 4). One end of the springs 26 rests against a wall that partially delimits the cutout 32 while the other spring end is supported on a follower part 33 of the cover plate 25 (FIG. 4). The springs 26 have the effect that the cover plate 25 is forced into the closed position. For moving the cover plate 25 into an open position, the latter has two driven parts 34 that are preferably provided with part-circular rounded glide surfaces 35 (FIG. 9) and are preferably arranged in an edge area of the cover plate 25. Moreover, a shaped seal 36 is provided that is arranged on the plug receptacle 7 approximately in the plane of the closure device 23 and surrounds the latter as a closed ring that must not be circular. The shaped seal 36 expediently may be comprised of a rubber-elastic material and may be supported in the base body 4 of the frame housing 1 in a groove.

The assembly housing 2 is substantially configured as a rectangular body and has on the bottom side that is facing the frame housing 1 a plug 37 that is delimited by a circumferential wall 38 formed of four wall parts wherein neighboring ones are arranged at a right angle relative to one another. The plug 37 with the circumferential wall 38 is thus substantially rectangular in cross-section. The circumferential wall 38 surrounds the contact pins 14 that are positioned at a spacing to one another and are connected electrically conductingly with the electric or electronic components arranged within the assembly housing 2. The diameter of the contact pins 14 is selected such that it is minimally smaller than the diameter of the insertion bores 13 of the insulation bodies 10 in the frame housing 2. When the plug 37 is inserted into the plug receptacle 7, between the circumferential surface of the contact pins 14 and the inner surface of the insertion bores 13 there is a flame-proof or spark ignition-proof gap 39, respectively, that is defined by DIN EN 50018 and DIN EN 60079.

Moreover, the plug 37 has a stay-shaped or wall-shaped drive part 40 that extends downwardly in the direction toward the frame housing 1. The drive part 40 is longer than the contact pins 14 and has at its free end a pushing surface 41 that projects past the free ends of the contact pins 14. The pushing surface 41 is positioned on the drive part 40 as a ramp surface relative to the insertion direction of the plug 37 and is slanted at an angle of preferably approximately 45° and, upon insertion of the plug 37 into the plug receptacle 7, interacts with the driven part 34 of the cover plate 25. On the bottom side of the assembly housing 2 that is facing the base member 4 of the frame housing 1 there is moreover a slightly projecting sealing stay 42 that surrounds annularly the contact pins 14 and the circumferential wall 38. The annular shape of the sealing stay 42 is substantially identical to that of the shaped seal 36 on which the sealing stay 42 rests seal-lightly when the plug 37 is inserted.

On spaced apart parallel sidewalls 43, 44 of the assembly housing 2 a locking pin 45 is provided, respectively; these locking pins 45 are positioned opposite one another and project outwardly and in opposite directions. Moreover, on the exterior sides of the sidewalls 43, 44 a stay 46 is provided, respectively, and the stays 46 are positioned opposite one another. A wall section 47 of the sidewalls 43, 44 is somewhat inwardly recessed and delimited by an approximately wave-shaped edge contour 48. In accordance with this edge contour 48 the outer rims of the support walls 16, 17 also have an approximately wave-shaped end face contour 49 that matches the edge contour 48 in the completely assembled state illustrated in FIG. 10. The depth of the recessed wall sections 47 corresponds approximately to the thickness of the support walls 16, 17 that rest against the wall sections 47.

The actuator 3 has two spaced apart, parallel legs 50, 51 and a grip part 52 that may be slightly curved and connects the legs 50, 51 so that the actuator 3 is substantially embodied as a U-shaped bracket. The actuator 3 is arranged on the support walls 16, 17 of the frame housing 1 and is pivotably supported. For this purpose, a bearing part 53 is arranged on the inner faces of the legs 50, 51 at their free ends, respectively, and these bearing parts 53 are positioned mirror-symmetrically opposite one another and each have a guide groove 54. The bearing parts 53 are embodied as circular disks and are positive-lockingly supported in the bearing receptacles 19 of the support walls 16, 17 wherein the center axes of the circular bearing parts 53 form the pivot axis of the actuator 3.

Adjacent to the circumferential area of the bearing parts 53, a blocking member receptacle 68 is formed on the legs 50, 51 of the actuator 3, respectively. Blocking members 67 of the support walls 16, 17 engage positive-lockingly these receptacles 68 in such a way that the actuator 3 is secured captively in its end positions as well as during its pivot movement and cannot be removed.

The guide grooves 54 are embodied with approximately radial orientation in the bearing part 53 and extend from an insertion opening 55 formed at the circumferential rim of the bearing parts 53, respectively, approximately semi-circularly in the direction toward the center axis of the bearing part 53. The width of the guide grooves 54 is sized such that it is approximately identical or only slightly greater than the diameter of the locking pins 45 so that the latter are guided substantially without play in the guide grooves 54. Moreover, on the inner faces of the two legs 50, 51 of the actuator 3 there are two abutments 56 that are mirror-symmetrically positioned opposite one another and rest against a stop 57 of the locking cams 22. A ramp 58 for the locking cam 22 is arranged in front of the abutments 56 and a recess 59 is arranged behind the abutments 56, respectively. Moreover, the actuator 3 has on its legs 50, 51 nose-shaped projections 60 that have on their inner sides locking edges 61 that are arranged mirror-symmetrically opposite one another. In the locked position of the actuator 3 the projections 60 engage across a wall part 62 formed on oppositely positioned sides of the locking device 5, respectively. The wall parts 62 have a locking edge 63 resting against the locking edge 61 of the projection 60 so that an accidental movement of the locking device 5 into a release position is prevented.

Figure 2:
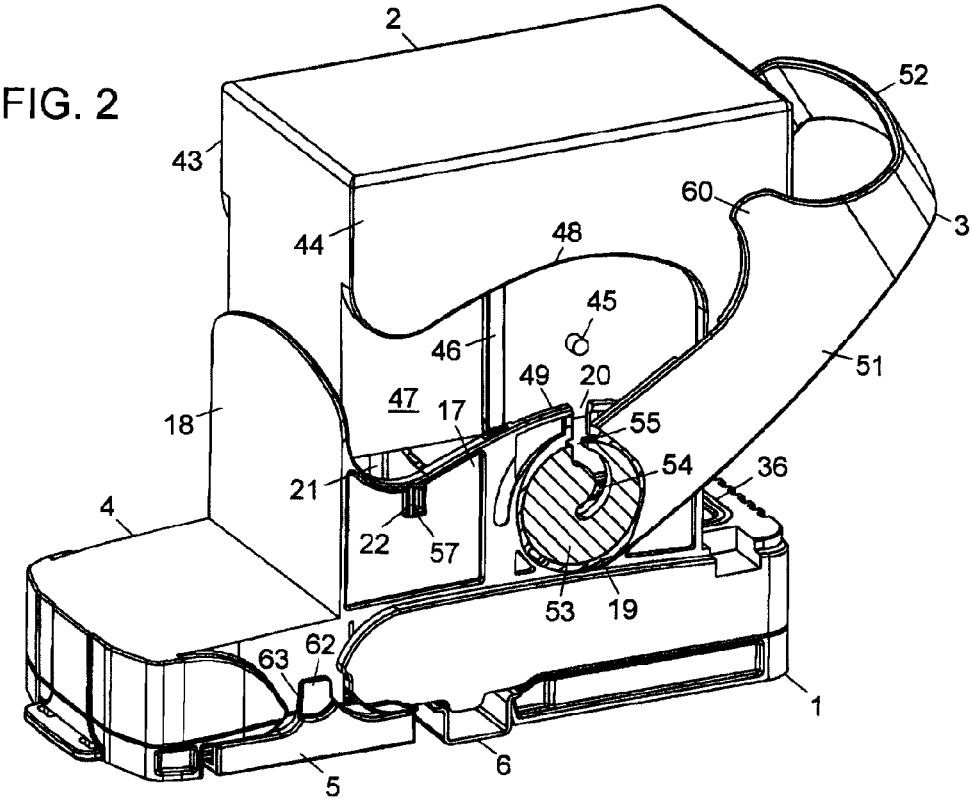
FIG. 2 shows the device of FIG. 1 in a first mounting position of an assembly housing insertable into the frame housing, partially in section.
Figure 3:
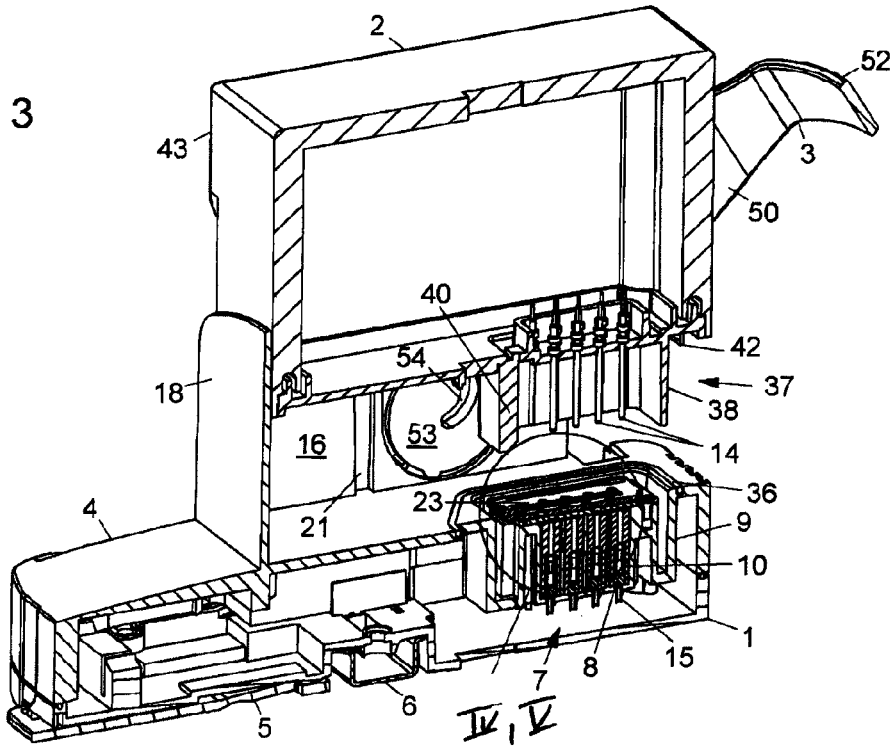
FIG. 3 shows the device in the mounting position of FIG. 2 in a section illustration.

In FIGS. 2 and 3 the assembly housing 2 of the device 1, whose frame housing 1 is attached by means of the locking device 5 on the cap rail 6, is shown in a first mounting position. The actuator 3 is pivoted in clockwise direction all the way to the rear into a limited release position wherein the inlet openings 21 of the support walls 16, 17 and the insertion openings 55 of the bearing parts 53 are congruently positioned. The assembly housing 2 is inserted into the receiving space of the frame housing 1 that is delimited on three sides by the support walls 16, 17 and the end wall 18 in such away that the stays 46 are positioned closely above the longitudinal grooves 21 and the locking pins 45 are positioned at a somewhat greater spacing above the inlet and insertion openings 20, 55. FIG. 3 shows that in this first mounting position the spacing of the assembly housing 2 above the frame housing 1 is so large that the plug 37 also has a definite spacing relative to the plug receptacle 7 of the frame housing 1.

Figure 5:
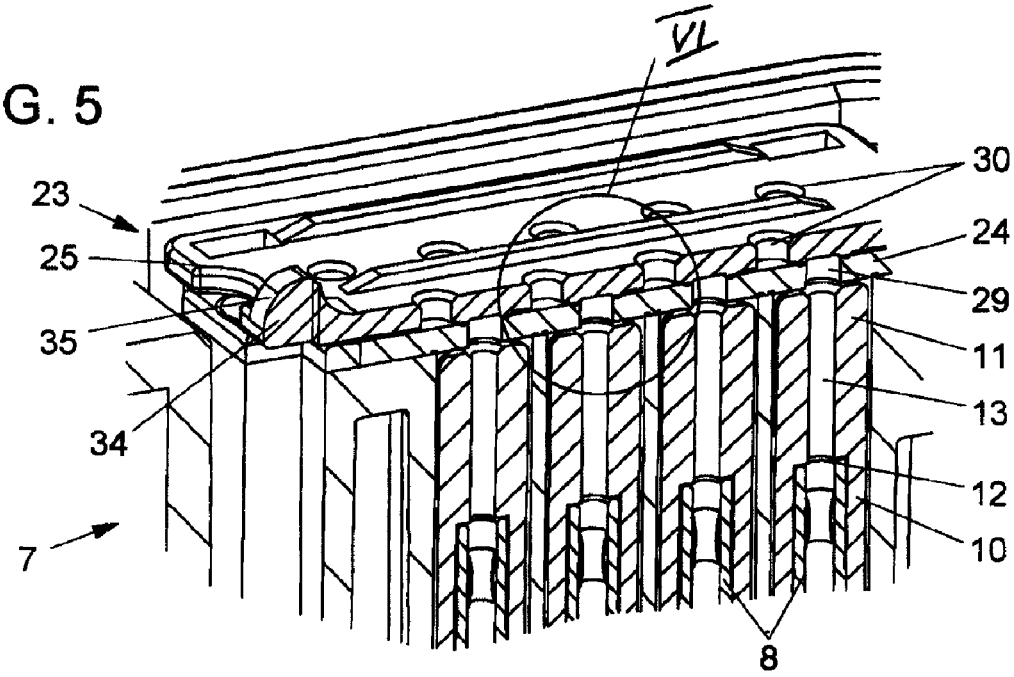
FIG. 5 shows a detail view of the plug receptacle and the closure device of the frame housing according to the detail V of FIG. 3.
Figure 6:
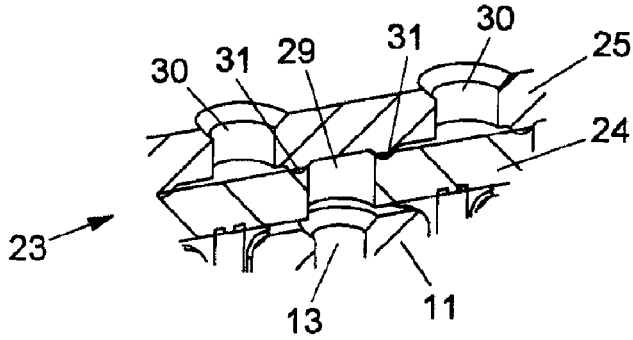
FIG. 6 shows a detail view of the plug receptacle and the closure device of the frame housing according to the detail VI of FIG. 5.

In this first mounting position of FIG. 2 and FIG. 3 the closure device 23, as also shown in FIGS. 4 to 6, is in the closed position wherein the cover plate 25 is pushed by the force of the springs 26 to the left, as shown in the illustration. In this closed position the through bores 30 of the cover plate 25 are not coaxial above the through bores 29 of the sealing plate 24, but instead are displaced to such an extent laterally that the cross-sections of the bores 29, 30 do not overlap. The through bores 29 of the sealing plate 24 are thus tightly closed off by the cover plate 25 from above so that no moisture, dust or dirt can reach the plug receptacle 7 and its contact tubes 8. In this way, a minimum protection class IP54 is provided in accordance with legal safety standards. The seal-tight closure of the plug receptacle 7 is assisted or improved by the seals 31 that are provided on the bottom side of the cover plate 25 and act on the top surface of the elastic sealing plate 24.

Upon further insertion of the assembly housing 2 into the frame housing 1 the pushing surface 41 that is leading the contact pins 14 pushes the drive part 40 against the glide surface 35 of the driven part 34 and moves the cover plate 25 out of the closed position to the right into the open position. In this open position the through bores 30 of the cover plate 25 are positioned directly above the through bores 29 of the sealing plate 24. In the open position of the cover plate 25, the through bores 30 are thus coaxial to the through bores 29, the insertion bores 13, the contact tubes 8, and the contact pins 14 so that the latter upon further insertion of the assembly housing 2 into the frame housing 1 can engage without any impairment the insertion bores 13.

Figure 7:
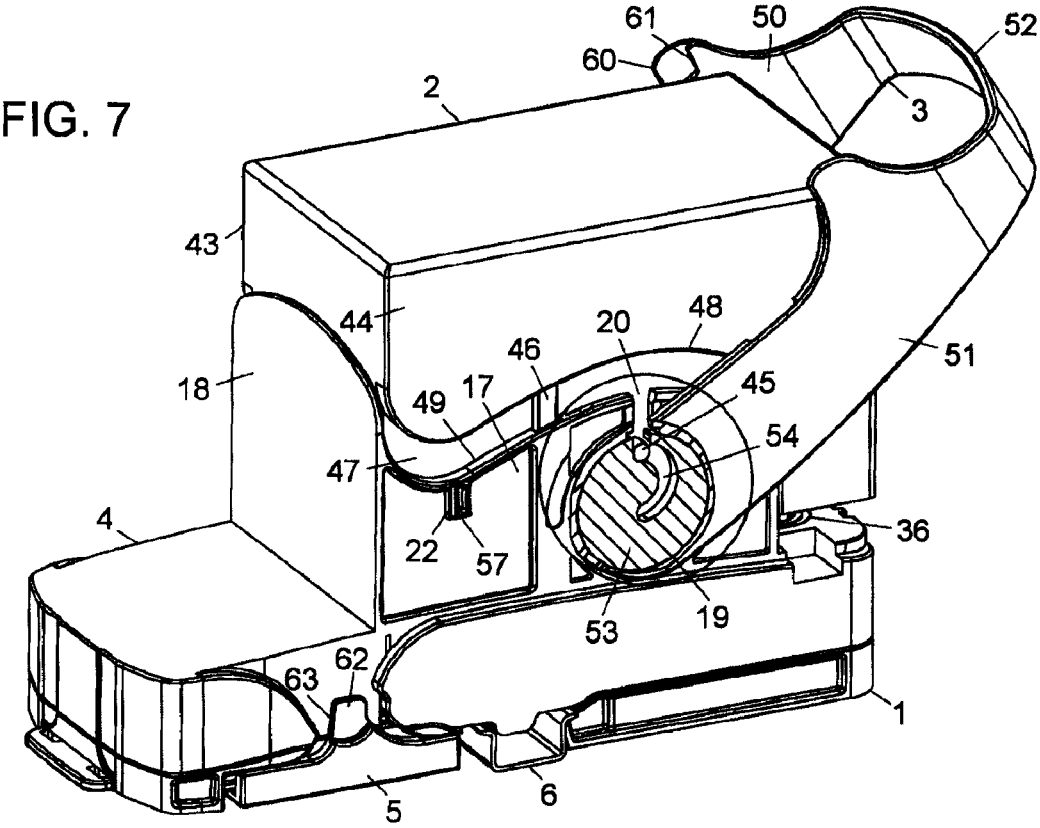
FIG. 7 shows the device similar to the view of FIG. 2 in a second assembly position, partially in section view.
Figure 8:
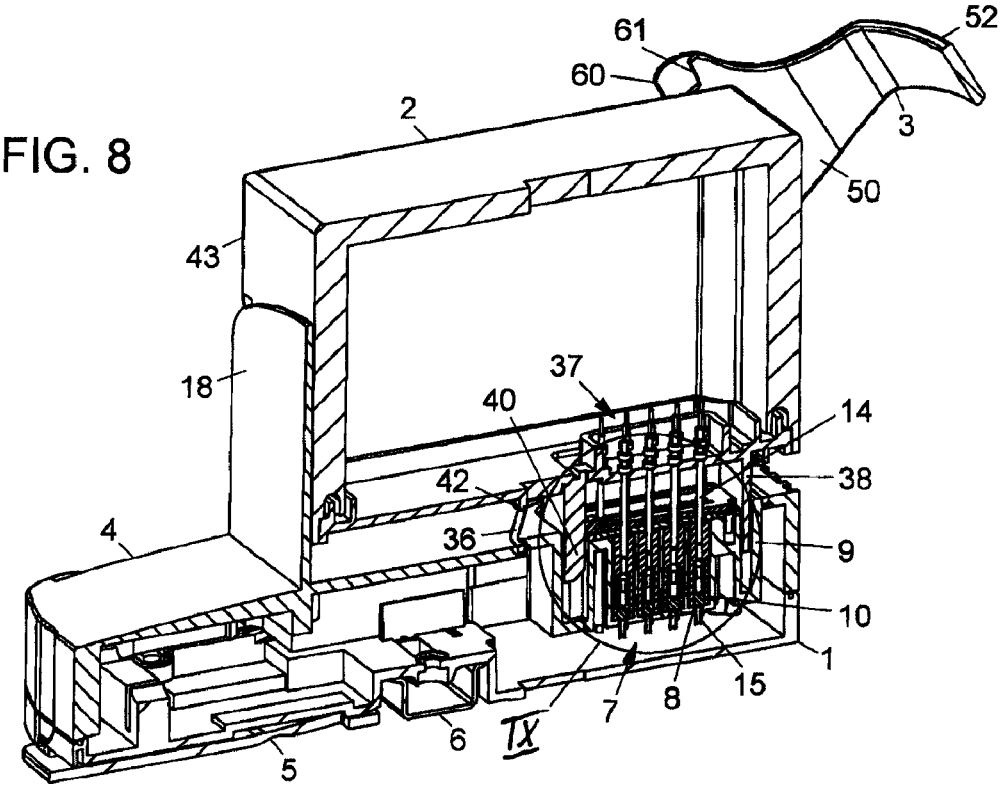
FIG. 8 shows the device in the mounting position of FIG. 7 in a section illustration.

FIGS. 7 and 8 show that the assembly housing 2 in comparison to the illustrations of FIGS. 2 and 3 has been pushed or pressed so far in the downward direction into the receptacle of the frame housing 1 that the plug 37 engages the upper part of the plug receptacle 7. The stays 46 are guided substantially without play in the longitudinal grooves 21 and ensure in this way a proper displacement into the illustrated second mounting position. The circumferential wall 38 of the plug 37 is inserted approximately with half its length into the slot-shaped cutout 64 that is preferably formed in the boundary wall 9 of the plug receptacle 7. The actuator 3 is still in its release position pivoted all the way to the rear and the locking pins 45 have passed through the inlet openings 20 and the insertion openings 55. They are now located at the beginning of the part-circular guide grooves 54 of the bearing parts 53. Further downward pressing or downward pushing of the assembly housing 2 in the direction toward the frame housing 1 is no longer possible. The assembly housing 2 can be moved farther in the direction toward the frame housing 1 only by pivoting the actuator 3 counterclockwise. As soon as the actuator 3 has been pivoted somewhat in the counterclockwise direction, the locking pins 45 are engaged from above within the guide grooves 54. In this position the assembly housing 2 is already secured by the positive-locking engagement of the locking pins 45 in such away that, for example, when an explosion-like counter pressure occurs in the area of the plug connection, the assembly housing 2 can no longer be pushed upwardly away from the frame housing 1.

Figure 9:
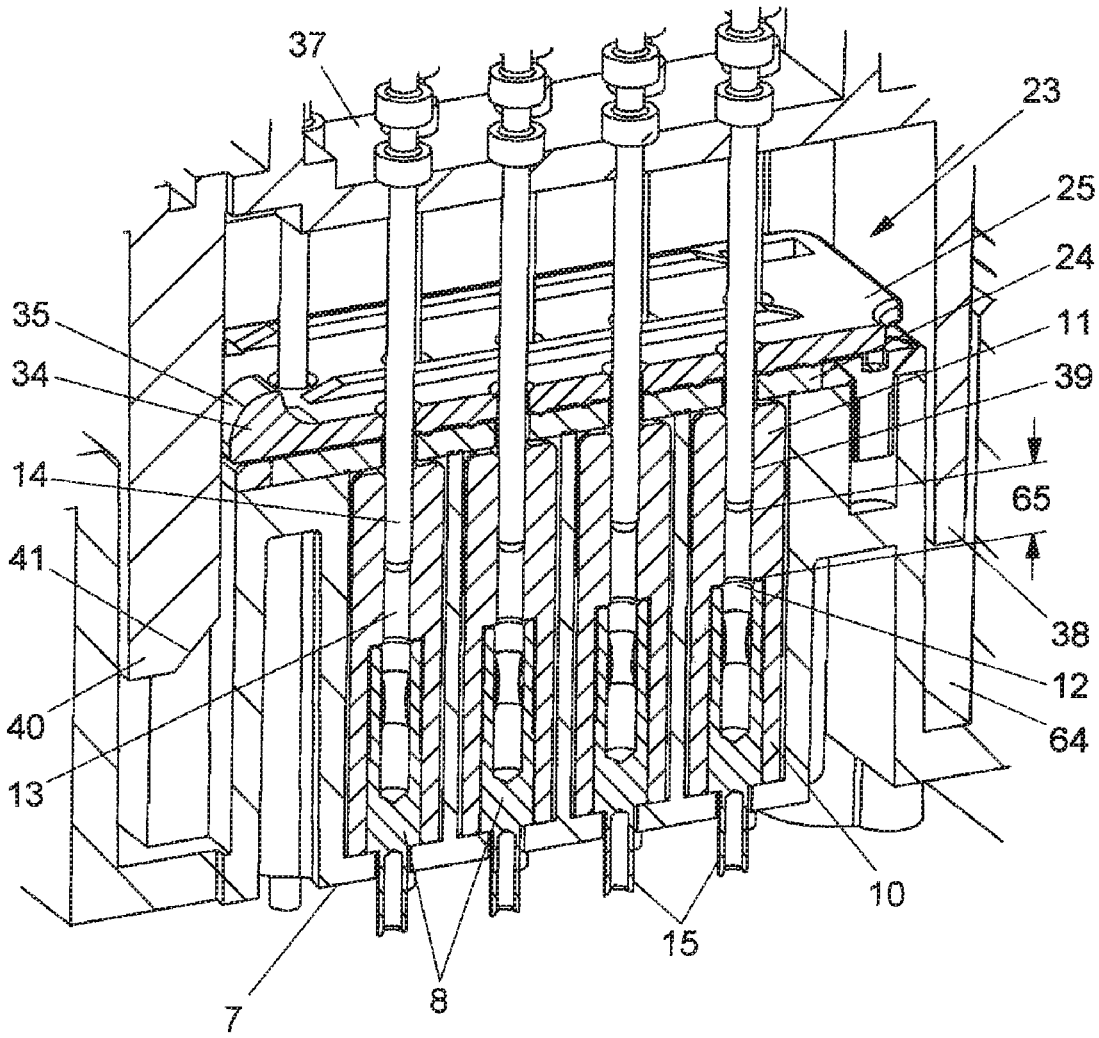
FIG. 9 shows a detail view of the plug, the plug receptacle, and the closure device according to the detail IX of FIG. 8.

The enlarged illustration of FIG. 9 shows that the contact pins 14 are located initially only in the insertion bores 13 of the insulation bodies 10 and do not yet correspond with the contact tubes 8. Between the free ends of the contact pins 14 and the tube openings 12 of the contact tubes 8 there is an axial minimum contact spacing 65 that corresponds to the regulations according to DIN EN 50018 and DIN EN 60079.

Figure 10:
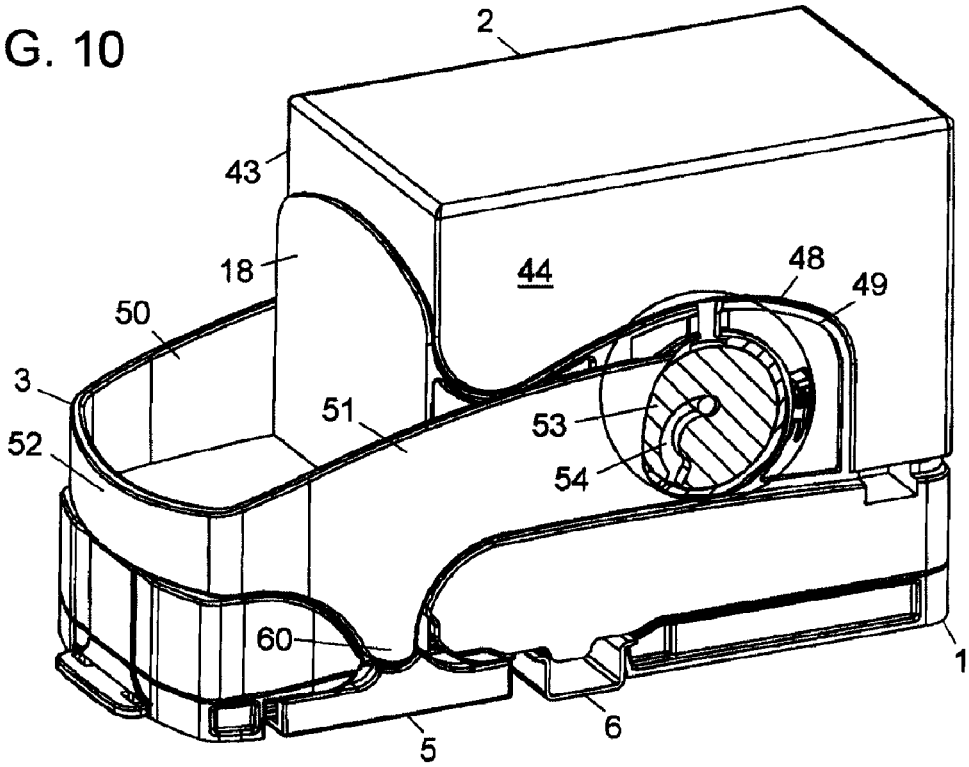
FIG. 10 shows the device of FIG. 7 in a completely assembled final position, partially in section.
Figure 11:
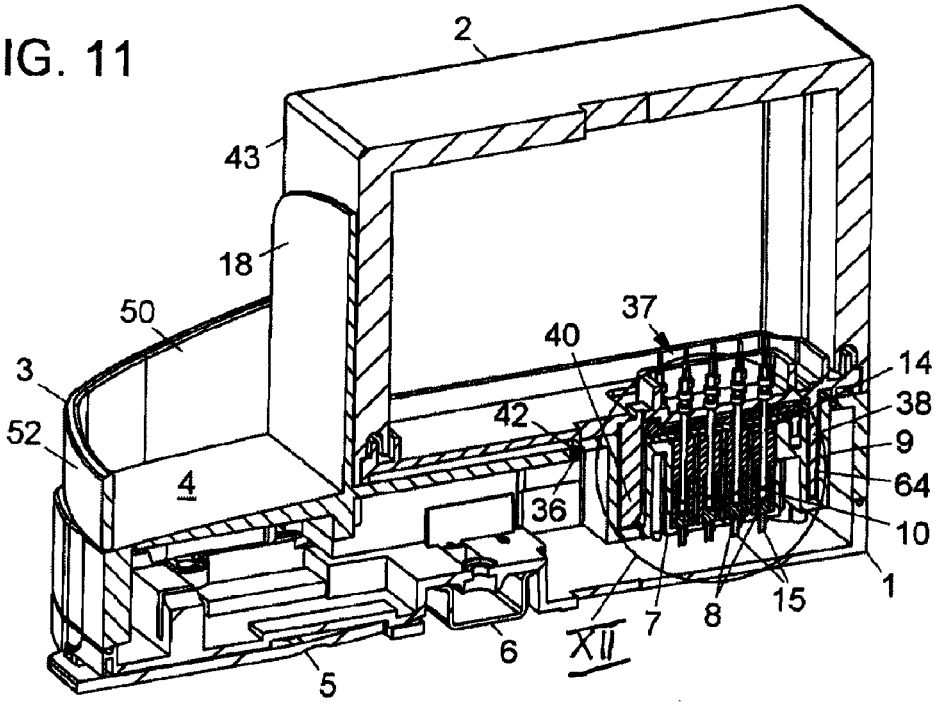
FIG. 11 shows the device of FIG. 10 in a section view.
Figure 12:
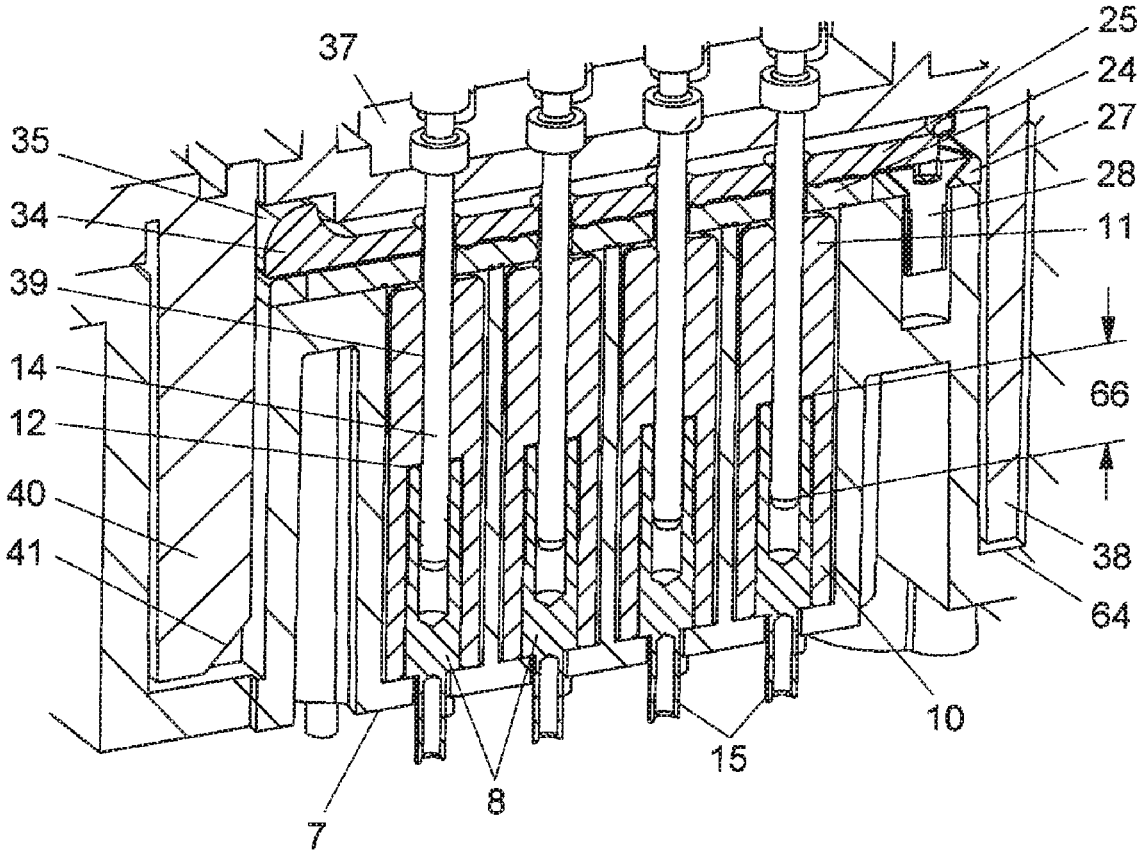
FIG. 12 shows a detail view of the plug connection according to detail XII of FIG. 11.

FIGS. 10 and 11 show the final assembled position. The actuator 3 has been pivoted in the counterclockwise direction and is now in its horizontal locked position. During pivoting the ramps 58 of the actuator 3, shortly before reaching the locked position, slide across the locking cams 22 of the support walls 16, 17 until, at the end of the pivot movement, the locking cams 22 snap into place in the recesses 59 of the actuator 3 so that the abutments 56 rests against the stops 57 of the locking cams 22. In this way, an accidental pivoting of the actuator 3 in clockwise direction is safely prevented and a stable fixation of the locked position is ensured.

Moreover, as a result of the pivoting action of the actuator 3 the locking pins 45, supported positive-lockingly in the semi-circular guide grooves 54 and thus forcedly guided therein, are moved in the downward direction toward the frame housing 1 and at the same time also pushed toward the end of the guide grooves 54. In this end position the locking pins 45 are preferably coaxial to the pivot axis of the actuator 3. Since the locking pins 45 are arranged stationarily on the assembly housing 2, the latter of course is also displaced in the downward direction against the frame housing 1 into its end position. In the illustrated locked position of the actuator 3 the projections 60 engage across the wall parts 62 of the locking device 5. In this connection, the locking edges 63 of the wall parts 62 rests against the locking edges 61 of the projections 60 and prevent thus horizontal displacement of the locking device 5 in the plane of the base member 4.

FIG. 11 shows that the circumferential wall 38 of the plug 37 is now completely inserted down to the bottom of the slot-shaped cutout 64 of the plug receptacle 7 and also the drive part 40 with the pushing surface 41 has been completely inserted into a slot-shaped cutout of the plug receptacle 7. The sealing stay 42 of the plug 47 is pressed onto the shaped seal 36 of the plug receptacle 7 so that the coupled plug connection is sealed all around with regard to damaging external influences. The contact pins 14 of the plug 37 are supported by means of axial minimum contact distance 66 in the contact tubes 8 of the plug receptacle 7. The minimum contact distance 66 is preferably longer than the afore described minimum contact spacing 65 so that a permanent reliable contacting action is provided.

When the assembly housing 2 is to be exchanged, for example, in case of a defect, the afore described mounting process is to be carried out in reverse. This means that first the securing action of the locked position of the actuator 3 must be released or canceled. Then the actuator 3 is to be pivoted in clockwise direction into the release position illustrated in FIG. 2 wherein the assembly housing 2 as a result of the eccentric guiding action for the locking pins 45 is moved away from the frame housing 1 in the upward direction and the plug connection is decoupled. After the release position of the actuator 3 has been reached, the assembly housing 2 can be pulled manually in the upward direction out of the receiving space of the frame housing 1 and a new one can be inserted. When the assembly housing 2 is not inserted into the frame housing 1, the plug receptacle 7 is advantageously securely protected against penetration of dirt, dust, moisture, splash water and similar foreign media. Also, the assembly housing 2 can be advantageously exchanged without any risk in explosion-hazardous environments during operation without the electric system having to be shut down. For this purpose, no fixed connections must be detached; all connectors remain connected to the frame housing 1. Neither during insertion nor during removal of the assembly housing 2, sparks that are produced in the interior of the plug connector can penetrate to the exterior and cause ignition of an explosive surrounding atmosphere so that, as a whole, a great safety standard is provided.

The specification incorporates by reference the entire disclosure of German priority document 10 2009 005 052.3 having a filing date of Jan. 15, 2009.

While specific embodiments of the invention have been shown and described in detail to illustrate the inventive principles, it will be understood that the invention may be embodied otherwise without departing from such principles.

What is claimed is:

1. An electric device comprising:

a plug connection comprising a plug with at least one contact pin and a mating plug receptacle with at least one contact tube;

a closure device arranged on said plug receptacle on a side facing said plug;

wherein said closure device comprises a cover plate comprising at least one through bore;

wherein said cover plate of said closure device has a closed position when said plug is not inserted, wherein in said closed position said cover plate covers said at least one contact tube for protecting said at least one contact tube;

wherein said cover plate of said closure device is moved by said plug into an open position when said plug is inserted into said plug receptacle, wherein in said open position said at least one through bore of said cover plate is in a coaxial position with said at least one contact tube so that access to said at least one contact tube is released.

2. The electric device according to claim 1, wherein said plug receptacle comprises at least one electrically non-conducting insulation body, wherein said at least one contact tube is arranged in said at least one insulation body, wherein said at least one insulation body and said at least one contact tube are floatingly supported, wherein said at least one insulation body has an insertion part that projects past a tube opening of said at least one contact tube, wherein said at least one insertion part has an insertion bore for said at least one contact pin, wherein between a circumferential surface of said at least one contact pin and an inner surface of said insertion bore a spark ignition-proof explosion protection gap in accordance with explosion protection regulations is formed.

3. The electric device according to claim 1, wherein said closure device is arranged in a plane above said insertion bore of said at least one insulation body on a top side of said plug receptacle facing said plug.

4. The electric device according to claim 1, wherein said closure device comprises a sealing plate comprising at least one through bore that is coaxial with said tube opening and said insertion bore, wherein said sealing plate is comprised of a rubber-elastic material and rest against a top side of said plug receptacle that is facing said plug.

5. The electric device according to claim 4, wherein said at least one through bore of said cover plate is adapted to receive said at least one contact pin, wherein said cover plate is arranged on a side of said sealing plate that is facing away from said at least one contact tube and is moveable in a plane coinciding with a plane of extension of said cover plate, and wherein, when said plug is removed from said plug receptacle, said cover plate is returned into said closed position in which said at least one through bore of said cover plate is in a radially displaced position adjacent to said at least one through bore of said sealing plate.

6. The electric device according to claim 5, wherein said at least one through bore of said sealing plate in said closed position of said cover plate is closed by said cover plate and is surrounded by a seal that is arranged on a side of said cover plate facing said sealing plate, wherein said seal is an annular projection monolithically formed on said cover plate and pressing against said sealing plate.

7. The electric device according to claim 1, wherein said plug connection comprises a sealing device that is comprised of a shaped seal that is arranged on said plug receptacle and surrounds said closure device and further comprised of a sealing stay that is arranged on said plug and surrounds said at least one contact pin, wherein said sealing stay sealingly interacts with said shaped seal.

8. The electric device according to claim 1, wherein said plug receptacle and said closure device are arranged on a frame housing and said plug is arranged on a bottom side of an assembly housing inserted into said frame housing, wherein said bottom side faces said frame housing, wherein an actuator is pivotably arranged on a support wall of said frame housing and said actuator in a locked position secures said assembly housing in said frame housing.

9. The electric device according to claim 8, wherein said at least one contact pin and said at least one contact tube engage one another when said assembly housing is inserted in said frame housing and said actuator is in said locked position, wherein said actuator is secured in said locked position against accidental return pivoting into a release position.

10. The electric device according to claim 8, wherein said assembly housing has opposed sidewalls each provided with a locking pin and a stay, wherein said frame housing has two spaced-apart parallel support walls and an end wall connecting said two support walls at one end, wherein said plug receptacle is arranged between said two support walls, wherein said support walls each have a bearing receptacle with an inlet opening, a locking cam, a longitudinal groove, and a blocking member, wherein said actuator comprises two legs and a grip part connecting said two legs at one end so that a U-shaped bracket is formed, wherein said two legs each have a bearing part, provided with a guide groove and an insertion opening, and further have a blocking member receptacle, wherein said locking cams engage said guide grooves and said blocking members engage said blocking member receptacles.

11. An electric device comprising:

a plug connection comprising a plug with at least one contact pin and a mating plug receptacle with at least one contact tube;

a closure device arranged on said plug receptacle and having a closed position for protecting said at least one contact tube;

wherein said closure device is moved by said plug into an open position when said plug is inserted into said plug receptacle, wherein in said open position said at least one contact tube is released;

wherein said closure device comprises a sealing plate comprising at least one through bore that is coaxial with said tube opening and said insertion bore, wherein said sealing plate is comprised of a rubber-elastic material and rest against a top side of said plug receptacle that is facing said plug;

wherein said closure device comprises a cover plate comprising at least one through bore for said at least one contact pin, wherein said cover plate is arranged on a side of said sealing plate that is facing away from said at least one contact tube and is moveable in a plane coinciding with a plane of extension of said cover plate;

wherein, when said plug is inserted into said plug receptacle, said cover plate is moved from a first position defining said closed position of said closure device into a second position defining an open position of said closure device, wherein in said second position said at least one through bore of said cover plate is coaxial to said at least one contact tube;

wherein, when said plug is removed from said plug receptacle, said cover plate is returned into said second position in which said at least one through bore of said cover plate is in a radially displaced position adjacent to said at least one through bore of said sealing plate;

wherein said cover plate is secured by a spring in said first position and is movable against a force of said spring into said second position, wherein said spring is supported on a follower part of said cover plate, said cover plate having at least one driven part for movement of said cover plate, wherein said at least one driven part has a glide surface for at least one drive part of said plug.

12. The electric device according to claim 11, wherein said drive part of said plug has a pushing surface oriented against said at least one driven part of said cover plate, wherein said pushing surface is a ramp surface and said glide surface is a rounded surface or said pushing surface is a rounded surface and said glide surface is a ramp surface.

13. The electric device according to claim 12, wherein said drive part of said plug is longer in an insertion direction of said plug than said at least one contact pin and wherein said pushing surface projects past a free end of said at least one contact pin.

14. An electric device comprising:

a plug connection comprising a plug with at least one contact pin and a mating plug receptacle with at least one contact tube;

a closure device arranged on said plug receptacle and having a closed position for protecting said at least one contact tube;

wherein said closure device is moved by said plug into an open position when said plug is inserted into said plug receptacle, wherein in said open position said at least one contact tube is released;

wherein said closure device comprises a sealing plate comprising at least one through bore that is coaxial with said tube opening and said insertion bore, wherein said sealing plate is comprised of a rubber-elastic material and rest against a top side of said plug receptacle that is facing said plug;

wherein said closure device comprises a cover plate comprising at least one through bore for said at least one contact pin, wherein said cover plate is arranged on a side of said sealing plate that is facing away from said at least one contact tube and is moveable in a plane coinciding with a plane of extension of said cover plate;

wherein, when said plug is inserted into said plug receptacle, said cover plate is moved from a first position defining said closed position of said closure device into a second position defining an open position of said closure device, wherein in said second position said at least one through bore of said cover plate is coaxial to said at least one contact tube;

wherein, when said plug is removed from said plug receptacle, said cover plate is returned into said second position in which said at least one through bore of said cover plate is in a radially displaced position adjacent to said at least one through bore of said sealing plate;

wherein said closure device comprises a fastening frame arranged on said plug receptacle, wherein said sealing plate, said cover plate and a spring that forces said cover plate into said first position are connected by said fastening frame to said plug receptacle.

15. An electric device comprising:

a plug connection comprising a plug with at least one contact pin and a mating plug receptacle with at least one contact tube;

a closure device arranged on said plug receptacle and having a closed position for protecting said at least one contact tube;

wherein said closure device is moved by said plug into an open position when said plug is inserted into said plug receptacle, wherein in said open position said at least one contact tube is released;

wherein said plug receptacle and said closure device are arranged on a frame housing and said plug is arranged on a bottom side of an assembly housing inserted into said frame housing, wherein said bottom side faces said frame housing, wherein an actuator is pivotably arranged on a support wall of said frame housing and said actuator in a locked position secures said assembly housing in said frame housing;

a locking device that is slidably arranged on said frame housing, wherein said frame housing is releasably locked with said locking device on a substantially U-shaped support rail, wherein said locking device is secured by said actuator against accidental sliding when said actuator is in said locked position.

* * * * *